United States Patent [19]

Peddinghaus et al.

[11] 3,996,830

[45] Dec. 14, 1976

[54] STAMPING DEVICE WITH VERTICALLY GUIDED FRAME

[75] Inventors: Werner Peddinghaus, Sprockhovel; Ludwig Regenbrecht, Gevelsberg, both of Germany

[73] Assignee: Rolf Peddinghaus, Bruchhausen, Germany

[22] Filed: Aug. 20, 1974

[21] Appl. No.: 498,915

[30] Foreign Application Priority Data

Aug. 21, 1973 Germany ..... 2342074

[52] U.S. Cl. ..... 83/558; 83/557; 83/615

[51] Int. Cl.[2] ..... B26D 5/08

[58] Field of Search ..... 83/50, 51, 543, 557, 83/558, 559, 560, 561, 579, 527, 566, 615, 623

[56] References Cited

UNITED STATES PATENTS

| | | | |
|---|---|---|---|
| 1,241,257 | 9/1917 | Wurts et al. | 83/615 X |
| 3,712,161 | 1/1973 | Valente | 83/558 X |
| 3,785,235 | 1/1974 | Peddinghaus et al. | 83/558 X |

*Primary Examiner*—Robert Louis Spruill
*Assistant Examiner*—W. D. Bray
*Attorney, Agent, or Firm*—Dressler, Goldsmith, Clement, Gordon & Shore, Ltd.

[57] ABSTRACT

A stamping device with vertically guided frame, which carries the matrix and vertically guides the stamping punch. When the vertically movable stamping punch hits the workpiece to be punched, the frame of the stamping device is lifted until the matrix engages the bottom side of the workpiece, whereupon in response to a further downward movement of the punch, the punching operation is carried out. The frame has associated therewith a balancing weight which is adjustable on the longer arm of a two-arm lever between two side plates of the frame, whereas the shorter arm of the two-arm lever supports the frame. The free end portion of the longer lever arm is connected to the frame by compensating and cushioning spring means.

8 Claims, 1 Drawing Figure

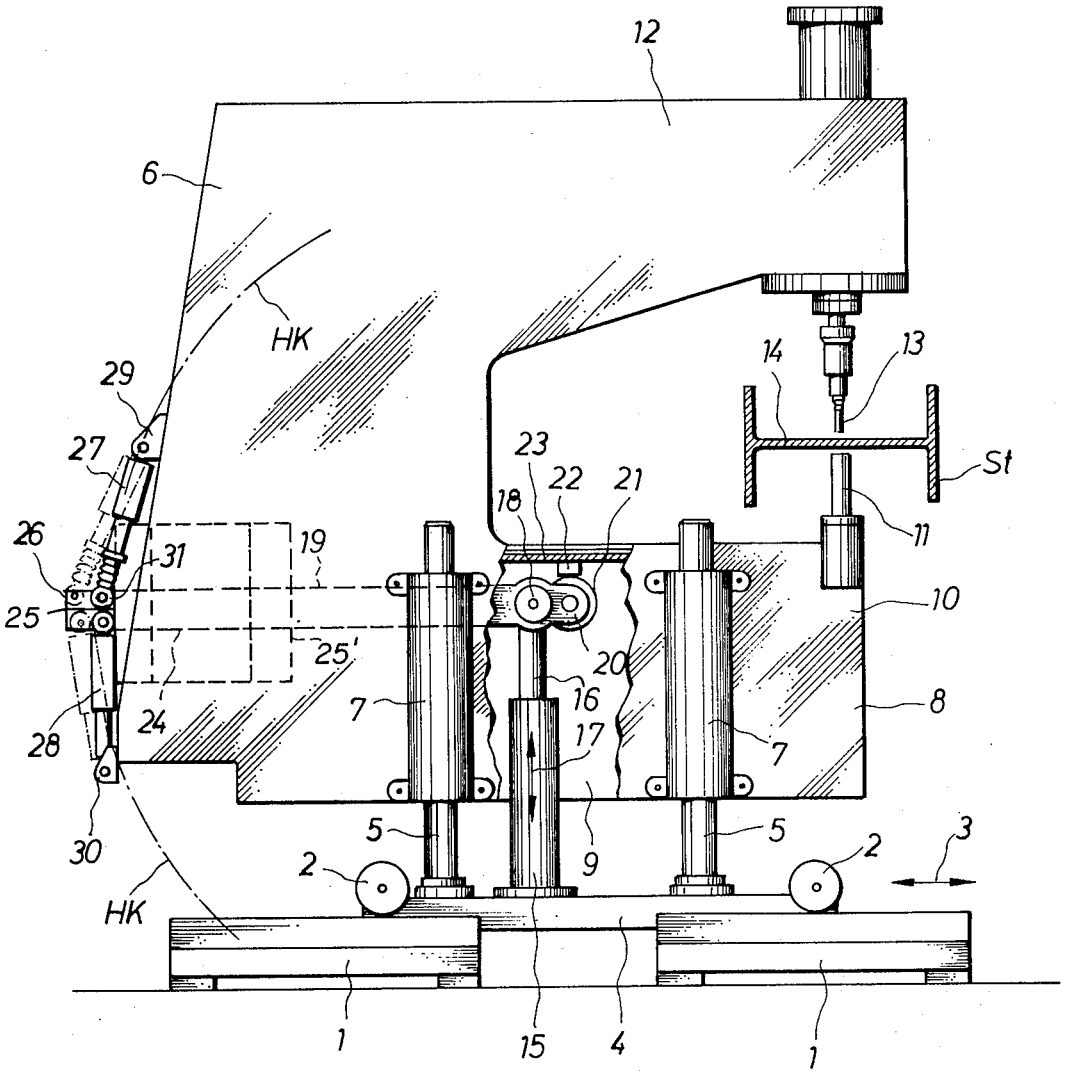
12
6
HK
29
27
26
31
19
25
25'
24
28
30
HK
14
13
St
23
22
21
18
11
10
20
16
17
7
8
7
5
5
9
2
2
3
1
15
4
1

STAMPING DEVICE WITH VERTICALLY GUIDED FRAME

The present invention relates to a punching device with a vertically guided frame which carries the matrix and vertically guides the stamping punch, and which when the stamping punch hits the material to be stamped is adjusted by said stamping punch until the matrix engages the material to be stamped. A balancing weight and at least one compensating and cushioning spring engages the frame in order to keep the stamping punch and the matrix in a slight and uniform distance from the material to be stamped in its starting position. In other words, the two stamping tools should by means of the stamping frame be kept in an intermediate starting position from which the frame is adjusted against the thrust of the spring.

German Offenlegungsschrift No. 20 47 215 corresponding to U.S. Pat. No. 3,785,235—Peddinghaus et al. dated Jan. 15, 1974 disclosed a stamping device in which a stamping frame is vertically guided which is under the effect of a counterweight that is connected to the stamping frame by means of a cable or chain passed over a reversing roller. The stamping frame is with this device acted upon in its vertical direction of movement by two springs and is held in an intermediate position relative to the material to be stamped, in which position the stamping punch and the material have the same and as slight distance as possible from the material to be stamped.

This known design of a stamping device has proven satisfactory in operation but has the drawback that considerable space is required for the counterweight and the guiding thereof.

Additionally, it has been suggested by the Italian Pat. No. 938,796 to rest the vertically guided stamping frame on pressure springs while one counterbearing of the pressure spring is adjustable in such a way that the stamping frame can again occupy an intermediate position relative to the material to be stamped in such a way that the stamping punch and the matrix will when in starting position have the same distance from the material to be stamped. With this design, however, it has been found that when employing a heavy frame for heavier stamping operations, strong springs have to be used and that a certain time is required until the damped spring oscillation of the frame following the stamping operation has ended.

It is, therefore, an object of the present invention to provide a stamping device of the above mentioned general type in which with simple means a weight balance will be obtained even for heavy stamping frames which frame on one hand will require relatively little space, while on the other hand a longer dampened post-oscillation of the frame will be avoided.

These and other objects and advantages of the invention will appear more clearly from the following specification in connection with the accompanying drawing illustrating a side view and partial section of the stamping frame of the stamping device according to the present invention.

The stamping device according to the present invention is characterized primarily in that the balancing weight is formed by a weight which is longitudinally displaceable on a beam, and that the guided frame rests on the shorter free beam section, whereas the compensating and damping spring connected to said frame engages the longer beam section.

In conformity with the length of the beam, a relatively short length is obtained for the weight to be displaced on the beam. Since the compensating and damping spring likewise engages the end of the longer beam section, also its effect is increased so that also a relatively weak spring may be employed which will not require or cause any longer damping of the oscillation.

According to a further preferred development of the invention, the frame of the stamping device is composed primarily of two side plates while the beam and the weight are arranged between the two frame plates. Such an arrangement results in a considerable space saving because the movable stamping frame itself can in its interior receive the weight and the beam. In this connection it is furthermore advantageous that the weight is guided by the guided frame itself so that no additional lateral sliding guiding means are required for the weight displaceably on the beam. The above mentioned Italian Pat. No. 938,796 also discloses to arrange the pressure springs between the two plates of the stamping frame. The present invention goes beyond this arrangement and suggests guiding the weight by the plates of the frame.

According to a further development of the invention, a supporting rod is arranged between the frame plates, the upper ends of which have the beam rotatably journaled thereon. This supporting rod is parallel to those parts which guide the frame and have the shape of columns and of corresponding bushings surrounding said columns. The free end of the short beam section may by means of a roller rest against the bottom side of a horizontal frame strut or an extension thereof.

In order to obtain the desired central position of the frame relative to the material to be punched, which means the respectively same slight distance of the stamping punch and the matrix with regard to the material to be stamped, the supporting rod is adjustable as to height. The supporting rod advantageously forms the piston rod of a cylinder piston unit.

According to a further development of the invention, a compensating and dampening spring is arranged above and below the longer beam section and extends in the direction of the semicircle which surrounds the pivot axis of the beam. In other words, the two springs preferably engage one end of the beam in a direction approximately perpendicular with regard to the longitudinal axis of the beam. In order to vary the tension of the springs, according to a further feature of the invention, the point of attack of the springs on the beams is adjustable. In this connection two points of attack of the spring may be adjustable together, and if desired, the point of attack of each individual spring on the beam may be adjustable independently of the point of attack of the second spring.

The weight on the beam is preferably adjustable and arrestible in an infinitely variable manner, as will be explained more fully later.

Referring now to the drawing in detail, the bottom plate 4 may be moved by means of rollers or wheels 2 on the foundation part 1 in the direction of the double arrow 3. The bottom plate 4 has four vertical columns 5 arranged along a rectangle. The distance between two columns in the transverse direction of the bottom, in other words transverse to the direction of movement, corresponds approximately to the thickness of frame 6 which by means of bushings 7 of the two side plates 8,9 of frame 6 is guided on the columns. The columns 5 and the bushings 7 by their rectangular arrangement on the outsides of the frame plates 8,9 will assure a precise vertical guiding of the frame 6 relative to the horizontally displaceable bottom plate 4. The frame 6 is formed as a U-shaped yoke the legs 10 of which support the matrix 11, whereas the stamping punch 13 with its guiding and driving means is mounted on the leg 12, and stamping material St is positioned between punch 13 and matrix 11 and is supported in the manner disclosed in the above mentioned United States Patent. When the vertically movable stamping punch impacts upon the web 14 of the stamping material St to be stamped, the frame 6 is lifted until the matrix 11 engages the bottom side of web 14 whereupon in response to a further lowering of the stamping punch 13 the stamping hole is obtained as punched thereby. In its starting position, the stamping punch and the matrix should have a uniform and as small as possible distance from the web 14. To this end, at different heights of the web 14, an adjustability as to height of the starting position of frame 6 will be necessary.

For this purpose, the bottom plate 4 supports in the middle between the four columns 5 a cylinder piston rod 16 of which is attached to be lifted and lowered in the direction of the arrow 17. The upper end of the piston rod carries a pivot pin 18 for a beam 19 which similar to the parts 15, 16, 18 extends into the space between the two plates 8, 9 of frame 6. The shorter section 20 of the beam 19 has a roller 21 which from below rests against an extension 22 of a transverse strut 23 of frame 6 which strut connects the two plates 8, 9 to each other.

Piston 16, beam 19, and roller 21 define support means for supporting frame 6 which carries matrix 11 and stamping punch 13.

The longer section 24 of the beam 19 which is pivotable about the pivot or pin 18 has its end project from frame 6 and in the space between the plates 8, 9, carries a weight 25 which is displaceable in a stepless or continuous step-free manner of displacement in longitudinal direction of the beam 19, for instance from its position 25 to its position 25'. That is to say that the weight 25 can be moved to an infinite number of positions with respect to beam 19 to vary the balancing force for frame 6. The weight may be held or arrested in any adjusted position by suitable means (not shown), such as a set screw. Preferably the weight 25 is so designed and arranged that it is laterally guided by the two plates 8,9 without affecting the pivotal movement of the beam with the weight 25.

Compensating and dampening springs 27, 28 located along a semicircle HK around the pivot 18 and are connected to the free end 26 of beam 19 as clearly shown by the solid lines in the drawings. One end of said springs 27, 28 is connected to the beam 19 through connecting elements 31, whereas their second end is connected to the frame 6 at 29 and 30. The adjustable connection between beam 19 and springs 27, 28 may include any suitable means along the beam for the attachment of each spring thereto. Thus, the spring tension of both springs 27, 28 may be varied for instance when the springs 27, 28 are moved into the position indicated by the phantom line position shown in the drawing.

The function of weight 25 and springs 27 and 28, described above is generally the same as disclosed in U.S. Pat. 3,785,235. However, because of the position of pivot pin 18 on arm 19 and the fact that the weight 25 and springs 27 and 28 are located a substantial distance from pivot pin 18 means that a substantially smaller weight and lighter springs can be used due to the larger moment arm for the weight 25 and springs 27 and 28. This arrangement reduces the amount of oscillation developed during pivotal movement of frame 6 about pivot pin 18.

It is, of course, to be understood that the present invention is, by no means, limited to the specific showing in the drawings, but also comprises any modifications within the scope of the appended claims.

We claim:

1. A stamping device, which includes: vertically reciprocable frame means comprising means supporting a stamping punch and also comprising means for receiving thereon a workpiece to be punched, a bottom plate, fluid operable cylinder-piston means mounted on said bottom plate, two-arm lever means pivotally connected to said cylinder-piston means and comprising a shorter arm supporting said frame means and also comprising a longer arm having a free end portion, balancing weight means adjustable on said longer arm in the longitudinal direction thereof and compensating and cushioning spring means having one end connected to said frame means and an opposite end connected to the free end portion of said longer arm.

2. A device according to claim 1, in which said frame means includes two side plates arranged substantially parallel and in spaced relationship to each other and confining therebetween said two-arm lever means and said weight means while laterally guiding said weight means.

3. A device according to claim 2, in which said cylinder-piston means includes a piston rod having said two-arm lever means pivotally connected to its free end.

4. A device according to claim 1, which includes roller means supported by the free end of said piston rod and having said frame means resting thereon.

5. A device according to claim 3, in which said piston rod is adjustable and arrestable as to height.

6. A device according to claim 1, in which said spring means are respectively arranged above and below said longer arm and extend approximately along an arc having the center thereof located substantially on the pivot axis of said two-arm lever means.

7. A device according to claim 1, in which said spring means are adjustable with respect to said longer arm to vary the tension thereof.

8. A device according to claim 1, in which said balancing weight means is longitudinally movable on said longer arm to an infinite number of positions.

* * * * *